United States Patent [19]

Mapp

[11] 4,344,648

[45] Aug. 17, 1982

[54] DUST PAN FOR SLIDING GLASS DOOR

[76] Inventor: Calvin R. Mapp, 1351 NW. 12th St., Miami, Fla. 33125

[21] Appl. No.: 250,880

[22] Filed: Apr. 3, 1981

[51] Int. Cl.[3] ..... A47L 13/52

[52] U.S. Cl. ..... 294/55; 15/257.1

[58] Field of Search ..... 15/257.1, 257.3, 257.4, 15/257.6, 257.7, 257.9; D7/186; 294/55

[56] References Cited

U.S. PATENT DOCUMENTS 1,202,791 10/1916 Brownstein ..... 294/55 X 2,511,560 6/1950 Bechmann ..... 294/55 X

*Primary Examiner*—Edward L. Roberts

*Attorney, Agent, or Firm*—Jack E. Dominik

[57] ABSTRACT

Disclosed is a dustpan for door thresholds having a plurality of upstanding tracks which can be extruded, molded, or formed from a single piece of material. A handle extends from one side and a flash flange from the other. Between the handle and the flash flange are a plurality of track covers, and a plurality of U-shaped scoops between the track covers. The scoops and track covers are proportioned so that the scoops will fit down into the threshold faces between the parallel tracks. The method disclosed includes the steps of providing a dust pan having a plurality of track covers and spaced scoop portions proportioned to fit on a threshold for sliding glass panels. The pan is then positioned at one end of the threshold after the debris had been swept to that end and then the debris is placed upon the pan and optionally dumped. Thereafter the dirt which is swept to the opposite end of the door is engaged by the dust pan and swept thereon and dumped. When there is a large accumulation of debris the process may be repeated until satisfactory cleaning and debris removal has been achieved.

4 Claims, 5 Drawing Figures

DUST PAN FOR SLIDING GLASS DOOR

FIELD OF INVENTION

The subject invention is directed to dust pans, and more particularly those of the type which can be utilized in cleaning the thresholds of sliding glass doors. The prior art is classified in Class D44, subclass 18, Class 15, subclasses 257.1, 257.9, Class 294, subclasses 1, 49, 51, 55, 55.5 and 56.

THE PRIOR ART

The prior art is exemplefied by U.S. Pat. Nos. 2,511,560 and 2,666,309. Also relevant but not so pertinent are U.S. Pat. Nos. 1,132,067; 2,090,293; 1,583,916; 2,782,615; 3,020,077; 3,310,332; 4,138,153.

The principal problem addressed by the present invention is to provide not only a dust pan but a method of using the same which will efficiently remove debris from the threshold of a sliding glass door. The prior art as set forth above shows a whole host of devices for cleaning and removal, but none of which adapt themselves conveniently to the threshold of a sliding glass door.

Sliding glass doors leading to patios, yards, and even interiorly in houses invariably have a threshold which incline upwardly and from which extend a plurality of tracks to guide the sliding panel members which may be window panels, screen panels, or panels fixed to the track as a part of the door. Even windows in certain applications can be similarly structured, and in all instances the threshold will, particularly when outside the house, be a gathering place for leaves, cobwebs, twigs, and dirt and debris of all types. To remove this debris with a whiskbroom invariably leaves large portions of the material at one end or the other, and indeed portions in the middle of the threshold. It is to assist in the removal of debris from thresholds for sliding glass panels and the like that the invention addresses itself.

SUMMARY

The present invention is directed to a dustpan for door thresholds having a plurality of upstanding tracks which can be extruded, molded, or formed from a single piece of material. A handle extends from one side and a flash flange from the other. Between the handle and the flash flange are a plurality of track covers, and a plurality of U-shaped scoops between the track covers. The scoops and track covers are proportioned so that the scoops will fit down into the threshold faces between the parallel tracks.

The method of the present invention includes the steps of providing a dust pan having a plurality of track covers and spaced scoop portions proportioned to fit on a threshold for sliding glass panels. The pan is then positioned at one end of the threshold after the debris had been swept to that end and then the debris is placed upon the pan and optionally dumped. Thereafter the dirt which is swept to the opposite end of the door is engaged by the dust pan and swept thereon and dumped. When there is a large accumulation of debris the process may be repeated until satisfactory cleaning and debris removal has been achieved.

In view of the foregoing it is the principal object of the present invention to provide a dust pan for door thresholds having a plurality of upstanding tracks which can be efficiently employed to remove debris from the threshold.

A related object of the present invention is to provide a dust pan for door thresholds having a plurality of upstanding tracks which is inexpensive to manufacture, and yet efficient in use.

It is yet another object of the present invention to provide a method for cleaning door thresholds having a plurality of upstanding tracks which is efficient and effective.

THE DRAWINGS

Further objects and advantages of the present invention will become apparent as the following description of an illustrative embodiment proceeds taken in conjunction with the accompanying drawings, in which.

DESCRIPTION OF PREFERRED EMBODIMENT

Figure 1:
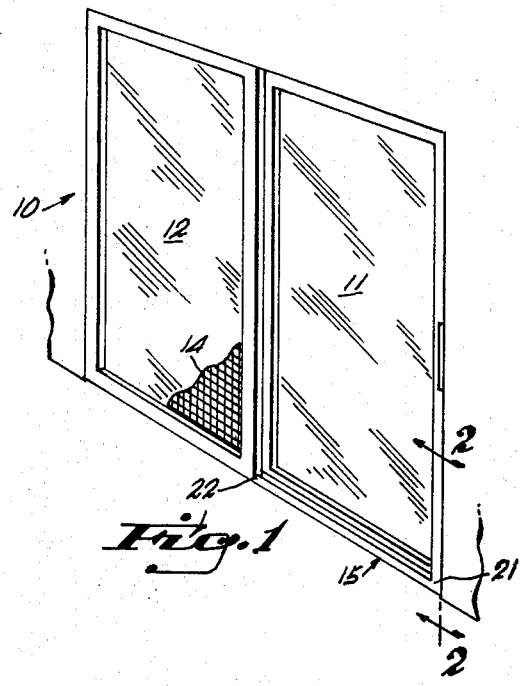
FIG. 1 is a perspective view of a typical door having a plurality of glass or window panels and a screen showing the location of the threshold to which the use of the present invention is directed.

The use of the dust pan exemplary of the present invention is primarily in the environment of a door such as shown in FIG. 1 as door 10. The door illustrated has a moving panel 11 and a fixed panel 12. Exteriorly of both panels provision is made for a screen 14. The screen 14, moving panel 11, and fixed panel 12 are all positioned atop a threshold 15 having a threshold base 16 which is mounted on the supporting slab for the door 10.

Figure 2:
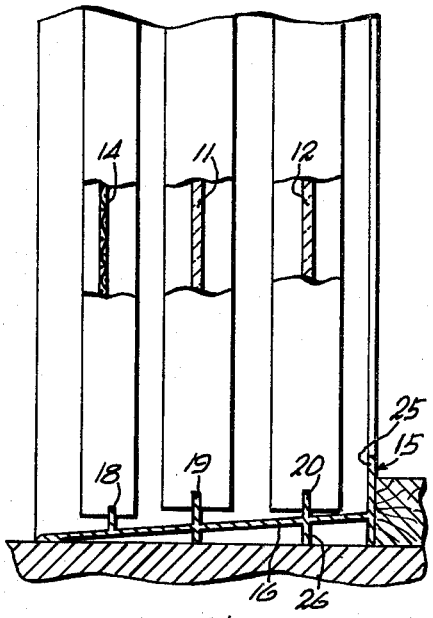
FIG. 2 is a transverse sectional view taken along section line 2—2 of FIG. 1 showing the relationship between the threshold and the window panels and screens.
Figure 3:
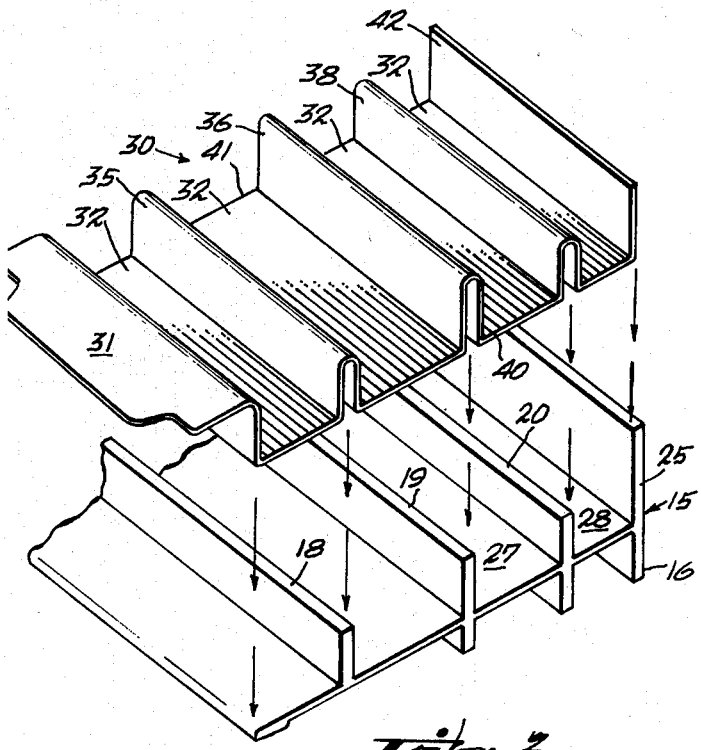
FIG. 3 is an exploded perspective view showing the spaced relationship between the dust pan and the threshold prior to engaging the threshold with the dust pan for cleaning the same.
Figure 5:
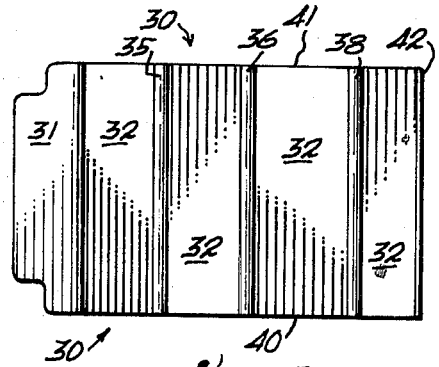
FIG. 5 is a top view of the dust pan.
Figure 4:
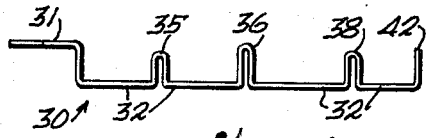
FIG. 4 is a front elevation of the dust pan.

The threshold 15, as shown in FIG. 2 as well as FIG. 3 includes a screen track 18, and outer panel track 19, and inner panel track 20 and a still flash 25. As noted in FIG. 1, there is a door end 21 of the threshold and a door mid-section 22 of the threshold. Where the two panels 11, 12 are both moving panels, the mid-section may vary from its position and indeed, be overlapped by both panels while the two ends of the threshold are left exposed.

Still supports 26 make up the threshold base 16 and extend downwardly from the threshold extrusion. To be noted particularly in FIG. 3 are the various grooves such as the still groove 27, and the flash groove 28. It will be appreciated that the present invention is directed to any threshold having upstanding tracks irrespective of whether there are one, two, three, or more.

The pan 30 as shown in FIG. 3 has a planar handle portion 31, base scoops 32, and screen track cover 35, outer track cover 36, inner track cover 38 and flash flange 42. In those instances where there are only two tracks, the flash flange 42 will be closer to the intermediate track covers, and in those instances where the threshold is wider it will be spaced a greater distance. The majority of sliding glass doors are substantially as illustrated here having three tracks and the still flash and accordingly the unit illustrated will have wide usage and application. It will be noted that the handle 31 is essentially parallel to the base scoop portions 32, that the two ends 40, 41 of the pan are in a plane essentially perpendicular to the long axis of the handle 31 as well as the long axis of the track covers 35, 36, 38. The height of each of the track covers 35, 36, 38 is proportioned so that the reversely folded U-shaped cross-section rides atop the corresponding tracks 18, 19, 20 of the threshold 15. The flash flange 42 is spaced from its adjacent track cover a distance to fit within the sill flash 25 with its vertical face abutting the sill flash 25 and riding downwardly into the flash groove 28.

The method of the present invention includes the steps of manipulating the subject dust pan 30 by first sweeping the dirt to one end of the door, and then to the other end of the door. Thereafter the pan 30 is positioned adjacent the door ends where the debris has been piled, and scooped under the debris to catch the same in the base scoops 32. The debris is then optionally removed, and the dust pan 30 positioned at the opposite end of the sliding glass door threshold 15 where other debris has been swept, and the step essentially reversed to position the debris in the base scoops 32. The process is repeated as often as necessary until the user is satisfied that the threshold is essentially clean of debris.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification, and the appended claims.

I claim:

1. A dust pan for door thresholds having a plurality of upstanding tracks to guide sliding door panels and screens comprising, in combination, an elongate flat handle, a plurality of U-shaped reversely folded track covers, a plurality of U-shaped scoop portions joining said track covers, a flash flange and adjacent U-shaped flash scoop remotely spaced from the handle, said track covers, flash, and scoops terminating at both ends of the dust pan in end faces essentially parallel to each other and perpendicular to the long axis of the handle.

2. In the dust pan of claim 1, said pan being extruded.

3. In the dust pan of claim 1, said track covers having a height and said scoops having a depth proportioned for the scoops to nest on the threshold while the track covers ride on the tracks.

4. In the dust pan of claim 1, said handle extending substantially the full length of the track covers and grooves.

* * * * *